US007090590B2

(12) United States Patent
Chen

(10) Patent No.: US 7,090,590 B2
(45) Date of Patent: Aug. 15, 2006

(54) GOLF CLUB HEADS

(75) Inventor: Chan-Tung Chen, Kaohsiung (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 26 days.

(21) Appl. No.: 10/674,490

(22) Filed: Oct. 1, 2003

(65) Prior Publication Data

US 2005/0075194 A1 Apr. 7, 2005

(51) Int. Cl.
*A63B 53/04* (2006.01)

(52) U.S. Cl. ..... 473/324

(58) Field of Classification Search ..... 473/290, 473/291, 305, 324, 336
See application file for complete search history.

(56) References Cited

U.S. PATENT DOCUMENTS 4,995,609 A 2/1991 Parente et al.
5,312,106 A * 5/1994 Cook ..... 473/336
5,451,048 A 9/1995 Magamoto et al.
5,611,740 A * 3/1997 Nagamoto ..... 473/305
5,695,409 A 12/1997 Jackson
5,795,240 A * 8/1998 Chappell ..... 473/291
RE35,931 E * 10/1998 Schroder et al. ..... 473/305
6,015,354 A * 1/2000 Ahn et al. ..... 473/256
6,431,995 B1 8/2002 Jackson

* cited by examiner

*Primary Examiner*—Raeann Gorden
(74) *Attorney, Agent, or Firm*—Birch, Stewart, Kolasch and Birch, LLP

(57) ABSTRACT

A golf club head includes a golf club head body having a toe and an engaging portion to which a striking plate is mounted, a hosel mounted to a side of the golf club head body, and a heel between the hosel and the engaging portion of the golf club head body. The heel includes a hole for reducing a weight of the heel, thereby shifting a center of gravity of the golf club head toward the toe of the golf club head body and increasing an inertial momentum of the golf club head.

20 Claims, 6 Drawing Sheets

GOLF CLUB HEADS

BACKGROUND OF THE INVENTION

1. Field of the Invention

The present invention relates to a golf club head. In particular, the present invention relates to a golf club head the weight of which is reduced for adjusting the center of gravity of the golf club head.

2. Description of Related Art

FIG. 1 of the drawings illustrates a typical golf club head 1 made of metal. The golf club head 1 includes a golf club head body 10, a striking plate 11, a heel 12, and a neck or hosel 13 to which a shaft (not shown) is mounted. The heel 12 connects the hosel 13 to the striking plate 11. The center of gravity 14 of the golf club head 1 is relatively close to the hosel side, as the hosel 13 has a considerable weight. Thus, the center of gravity 14 is not located in the sweet spot of the striking plate 11. As a result, the inertial moment of the golf club head 1 is reduced and the twist-resisting property of the golf club head 1 is adversely affected. Thus, the momentum imparted from the golf club head 1 to the golf ball is thus reduced. The striking effect of the golf club head 1 is adversely affected accordingly.

U.S. Pat. No. 4,995,609 discloses an improvement in iron golf clubs in which a hollow hosel is provided to thereby reduce weight of hosel and bridge that can be redistributed to the blade to increase the momentum that can be imparted to a golf ball. In an embodiment of the U.S. Pat. No. 4,995,609, as illustrated in FIG. 2 of the drawings, the golf club head 1 includes a golf club head body 10, a striking plate 11, and a hosel 13 to which a shaft 15 is mounted. A step 101 is formed in a lower end of a heel 12 between the hosel 13 and the golf club head body 10 to reduce the weight of the hosel side, thereby shifting the center of gravity 14 toward the toe 16 of the golf club head 1; namely, outwardly away from the heel 12, thereby increasing the inertial moment of the golf club head 1 that would lead to improvement in the striking effect of the golf club head 1 (i.e., the flying distance of the golf ball). However, although the center of gravity 14 is shifted outwardly away from the heel 12 through provision of the step 101 of the golf club head 1, the step 101 adversely affects the structural strength of the heel 12 of the golf club head 1. Further, the weight of the lower portion of the golf club head 1 is reduced since the step 101 is located in the lower end of the heel 12. Thus, the center of gravity 14 of the golf club head 1 is not only shifted outwardly away from the heel 12 but also shifted upward. As a result, the sweet spot of the striking plate 11 is thus too high. Essentially, provision of the step 101 in the golf club head 1 neither improves the striking effect nor increases the inertial moment of the golf club head 1. Further, the possibility of breakage or twist of the golf club head 1 is increased.

OBJECTS OF THE INVENTION

An object of the present invention is to provide a golf club head including a heel with a reduced weight to shift the center of gravity of the golf club head toward the toe of the golf club head, thereby increasing the inertial momentum of the golf club head and improving the striking effect of the golf club head.

Another object of the present invention is to provide a golf club head with improved shock-absorbing capacity and strengthened structure.

A further object of the present invention is to provide a golf club head allowing a relatively wide adjusting range for the center of gravity.

Still another object of the present invention is to provide a golf club head including a heel configured to shift the center of gravity of the golf club head downward, thereby increasing the inertial momentum of the golf club head and improving the striking effect of the golf club head.

SUMMARY OF THE INVENTION

According to one aspect of the invention, a golf club head includes a golf club head body having a toe and an engaging portion to which a striking plate is mounted, a hosel mounted to a side of the golf club head body, and a heel between the hosel and the engaging portion of the golf club head body. The heel includes a hole for reducing a weight of the heel, thereby shifting a center of gravity of the golf club head toward the toe of the golf club head body and increasing an inertial momentum of the golf club head.

The hole of the heel may be a through-hole or a blind hole having an opening in a front side or rear side of the heel. In an embodiment of the invention, the hole of the heel includes a relatively wider left portion and a relatively narrower right portion. Alternatively, the hole of the heel includes a relatively wider upper portion and a relatively narrower lower portion.

A light material is filled in the hole of the heel, thereby improving structural strength of the heel and absorbing a shock generated as a result of striking a golf ball.

In an embodiment of the invention, the heel includes a reduced section. A wrapping layer made of light material wraps around the reduced section of the heel and fills the hole of the heel, thereby improving structural strength of the heel and absorbing a shock generated as a result of striking a golf ball.

The light material is selected from a group consisting of carbon fiber, resin, rubber, high molecular polymeric material, and light alloy. The wrapping layer wraps the reduced section of the hosel by heat pressing or injection molding.

In another embodiment of the invention, the hosel includes a reduced section that is an extension of the reduced section of the heel, thereby decreasing a weight of an upper portion of the golf club head and shifting the center of gravity downward. The wrapping layer also wraps the reduced section on the hosel. The hosel includes an engaging hole for engaging with a shaft. In a further embodiment of the invention, the reduced section on the hosel extends through an entire length of the heel. Further, the reduced section on the hosel includes a flange formed on a distal end of the hosel for improving bonding stability between the engaging hole of the hosel and the shaft.

The reduced section on the hosel may include at least one protrusion or recessed portion on an outer periphery thereof for improving bonding stability between the reduced section and the wrapping layer.

The heel and the hosel are formed on the side of the golf club head body by precision casting, casting, mechanical processing, press casting, forging, or injection molding. Alternatively, the heel and the hosel are engaged to the side of the golf club head body by means of section-by-section engagement.

Other objects, advantages and novel features of this invention will become more apparent from the following detailed description when taken in conjunction with the accompanying drawings.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE PREFERRED EMBODIMENTS

Figure 1:
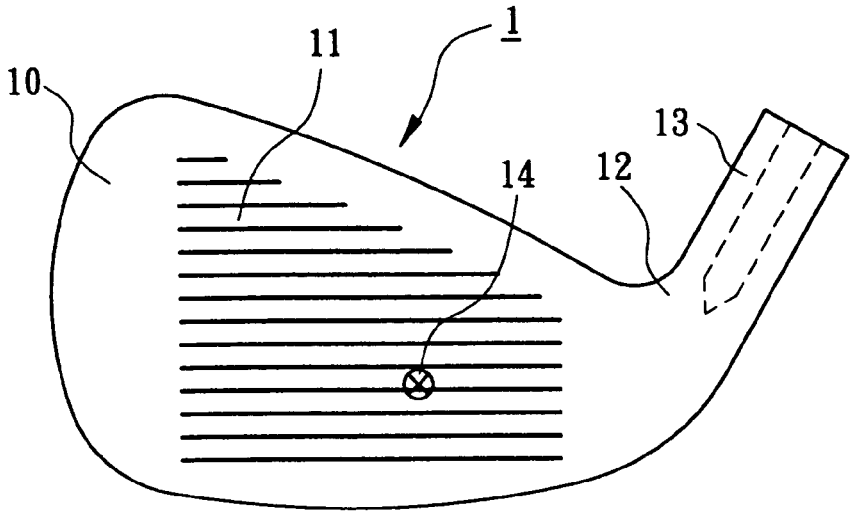
FIG. 1 PRIOR ART
FIG. 1 is a front view of a conventional golf club head.
Figure 2:
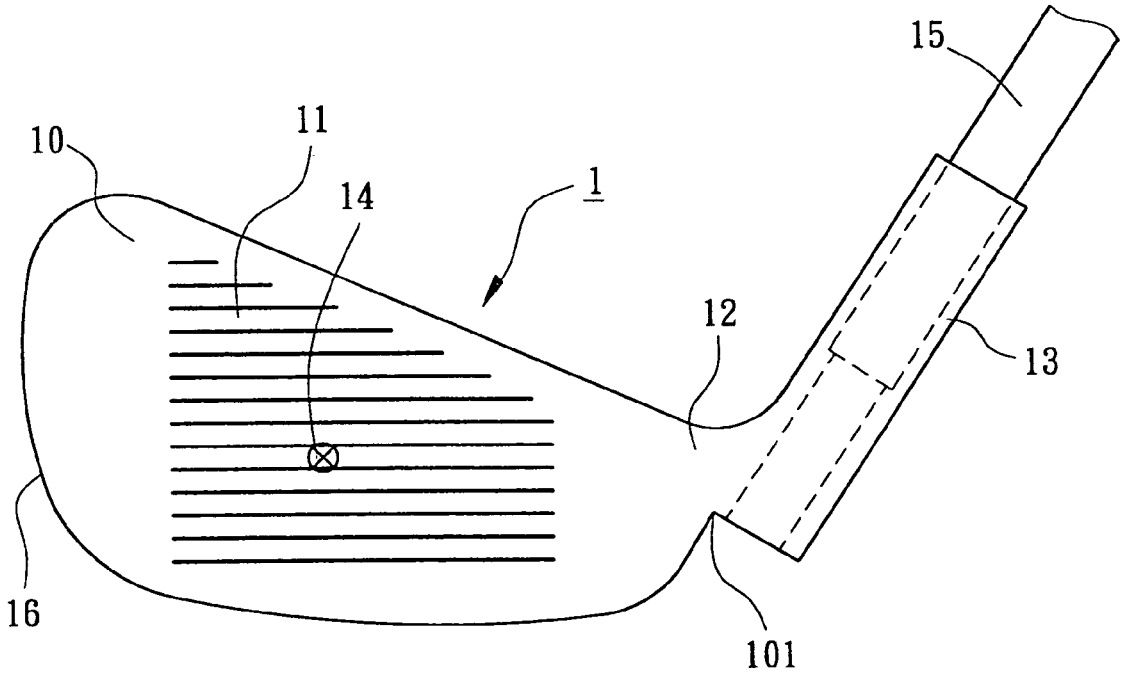
FIG. 2 PRIOR ART
FIG. 2 is a front view of another conventional golf club head.

Preferred embodiments of the present invention are now to be described hereinafter in detail, in which the same reference numerals are used in the preferred embodiments for the same parts as those in the prior art to avoid redundant description.

Figure 3:
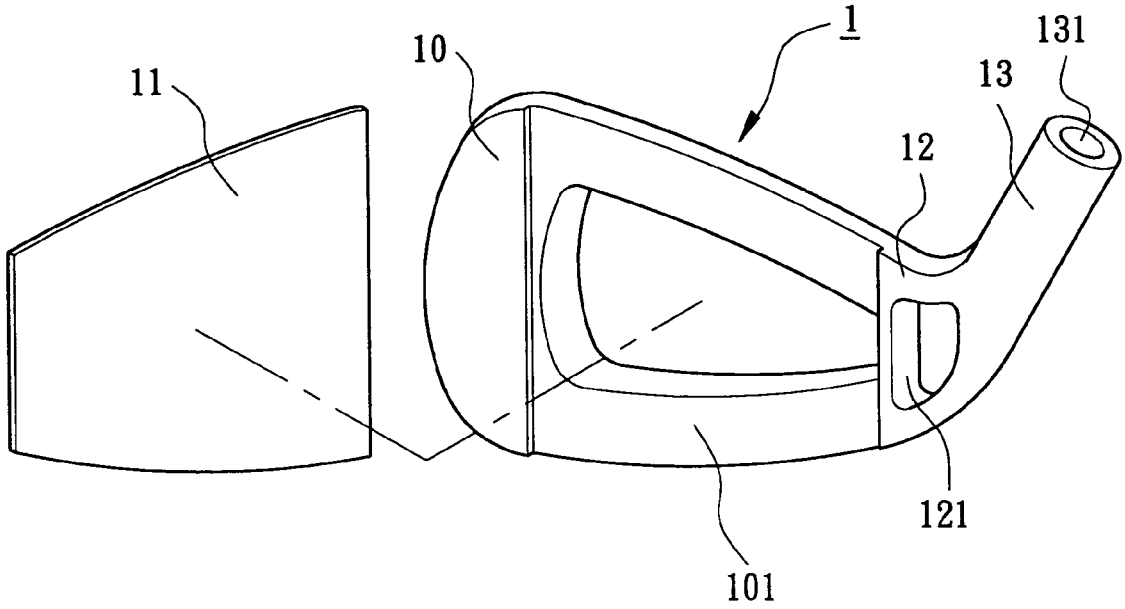
FIG. 3 is an exploded perspective view of a first embodiment of a golf club head in accordance with the present invention.
Figure 4:
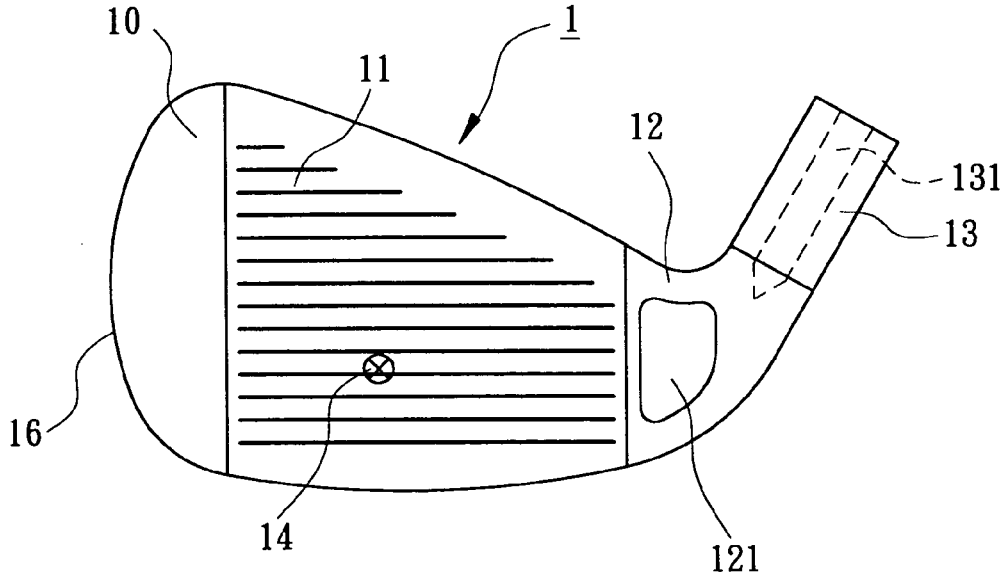
FIG. 4 is a front view of the first embodiment of the golf club head in accordance with the present invention.

Referring to FIGS. 3 and 4, a first embodiment of a golf club head 1 in accordance with the present invention is made of metal or alloy and includes a golf club head body 10, a striking plate 11 for striking a golf ball, a neck or hosel 13, and a heel 12 between the hosel 13 and the golf club head body 10. The golf club head body 10 includes an engaging portion 101. The striking plate 11 is integrally formed with the engaging portion 101 of the golf club head body 10. Alternatively, the striking plate 11 may be engaged with the engaging portion 101 of the golf club head body 10 by means of insertion, pressing, brazing, welding, screwing, etc.

The heel 12 includes a hole 121 for reducing the weight of the heel 12. The hole 121 may be a through-hole or a blind hole having an opening in a rear side or a front side of the heel 12. The hole 121 uniformly decreases the weight of an upper portion of the heel 12 and the weight of a lower portion of the heel 12. Thus, the center of gravity 14 of the golf club head 1 is shifted toward a toe 16 of the golf club head 1; namely, away from the heel 12. The inertial moment of the golf club head 10 is increased, and the striking effect (i.e., the flying distance of the golf club head 1) is improved.

The hosel 13 includes an engaging hole 131 for engaging with an end of a shaft (not shown). The heel 12 and the hosel 13 may be integrally formed on a side of the golf club head body 10 by means of precision casting, casting, mechanical processing, press casting, forging, molding injection, etc. Alternatively, the heel 12 and the hosel 13 are engaged to the golf club head 10 by means of section-by-section engagement.

Figure 5:
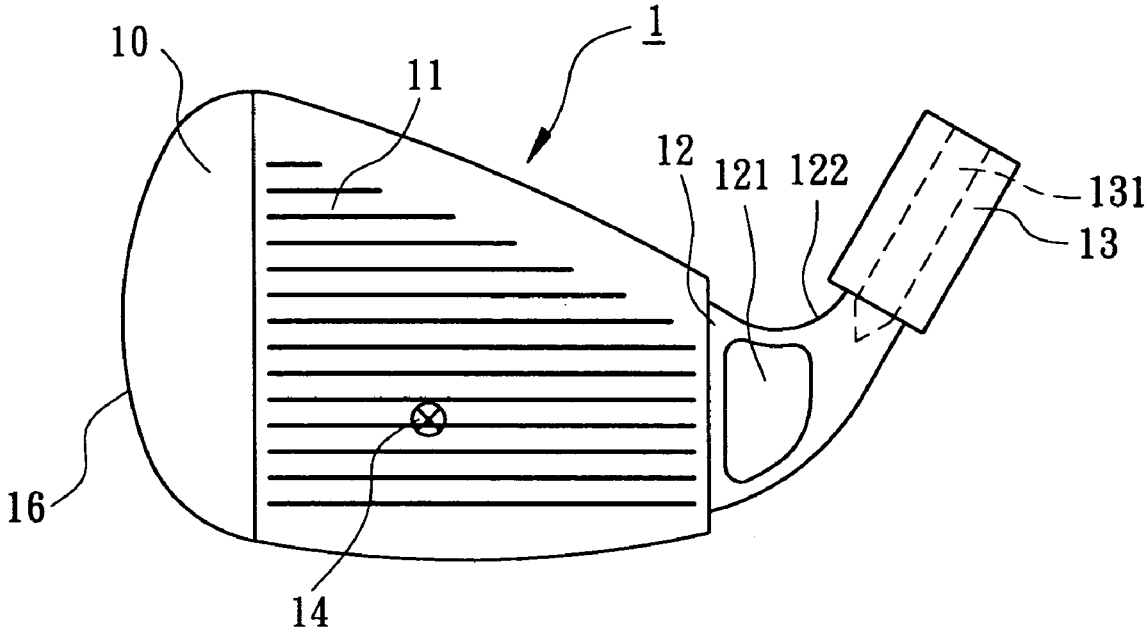
FIG. 5 is a front view of a second embodiment of the golf club head in accordance with the present invention before mounting of a wrapping layer.
Figure 6:
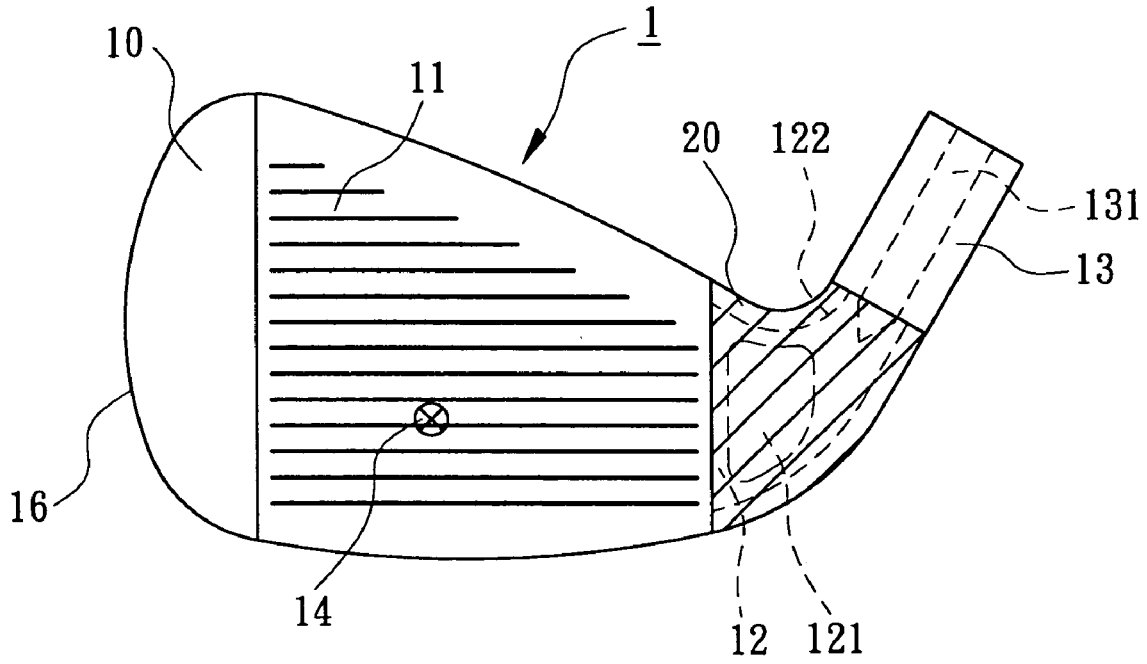
FIG. 6 is a front view of the second embodiment of the golf club head in accordance with the present invention.

FIGS. 5 and 6 illustrate a second embodiment of the golf club head in accordance with the present invention. In this embodiment, the heel 12 further includes a reduced section 122. The reduced section 122 further reduces the weight of the heel 12. A wrapping layer 20 is made of light material. The wrapping layer 20 wraps the reduced section 122 and fills the hole 121. The light material is selected from a group consisting of carbon fiber, resin, rubber, high molecular polymeric material, and light alloy such as titanium alloy or aluminum alloy. The wrapping layer 20 wraps the reduced section 122 of the hosel 12 by heat pressing or injection molding. The wrapping material 20 allows further decrease in the weight of the heel 12 without adversely affecting the structural strength of the heel 12. Meanwhile, the wrapping layer 20 increases the damping value of the heel 12 of the golf club head 1 during striking. The shock generated as a result of striking a golf ball is absorbed by the wrapping layer 20 without adversely affecting the moment of the striking plate 11, thereby improving the striking stability and gripping comfort.

Figure 7:
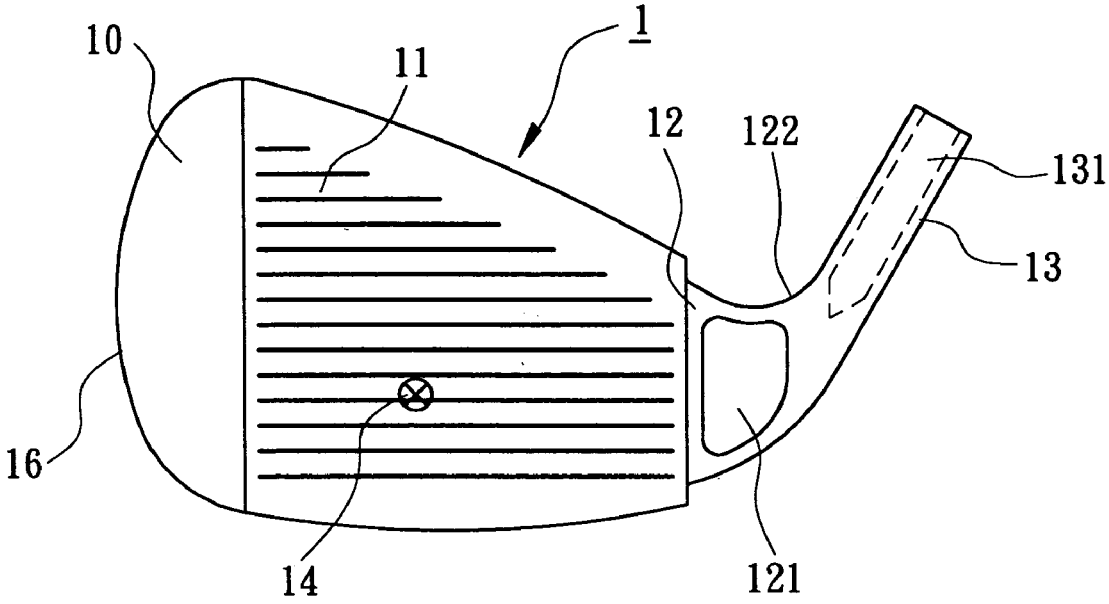
FIG. 7 is a front view of a third embodiment of the golf club head in accordance with the present invention before mounting of a wrapping layer.
Figure 8:
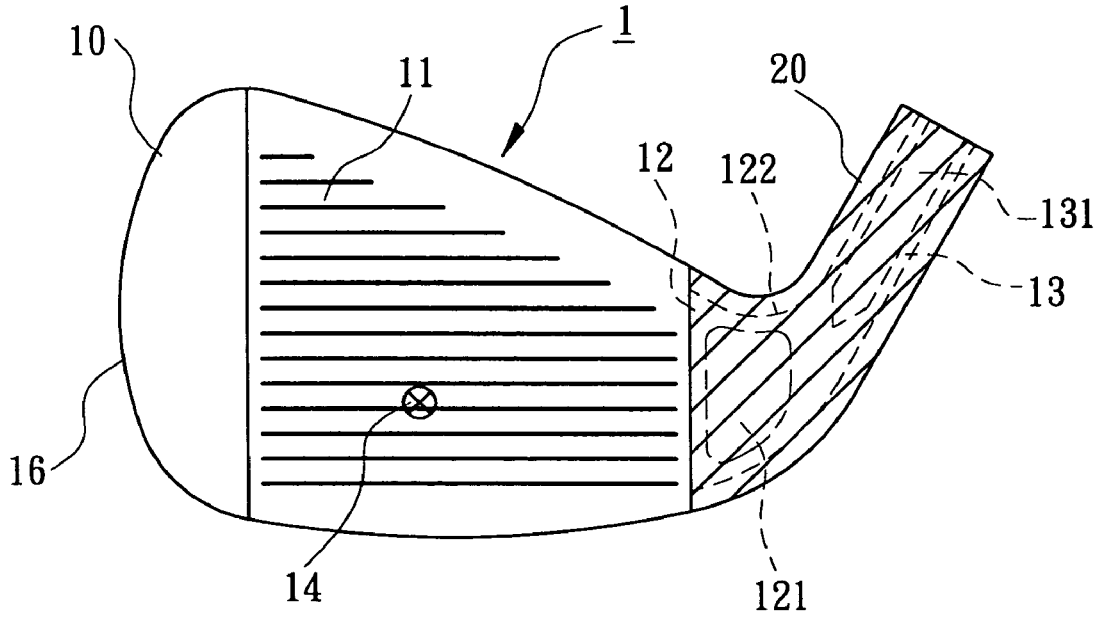
FIG. 8 is a front view of the third embodiment of the golf club head in accordance with the present invention.

FIGS. 7 and 8 illustrates a third embodiment of the golf club head in accordance with the present invention. In this embodiment, the reduced section 122 of the heel 12 extends throughout the hosel 13 (at least across a portion of the hosel 13). Namely, the hosel 13 also includes a reduced section that is an extension of the reduced section 122 of the heel 12. The center of gravity 14 of the golf club head 1 is shifted toward the toe 16 of the golf club head 1. The weight of the upper portion of the golf club head 1 is reduced, which causes downward shifting of the center of gravity 14 of the golf club head 1. Thus, the inertial moment of the golf club head 1 is further increased by the further extended reduced section 122. The extending area of the reduced section 122 can be adjusted according to need of the product. In an extreme case, the recessed section 122 extends through an entire length of the hosel 13, as shown in FIGS. 7 and 8. This allows an adjusting range of the center of gravity 14 of the golf club head 1. The wrapping layer 20 wraps the reduced section 122 in a way similar to the second embodiment.

Figure 9:
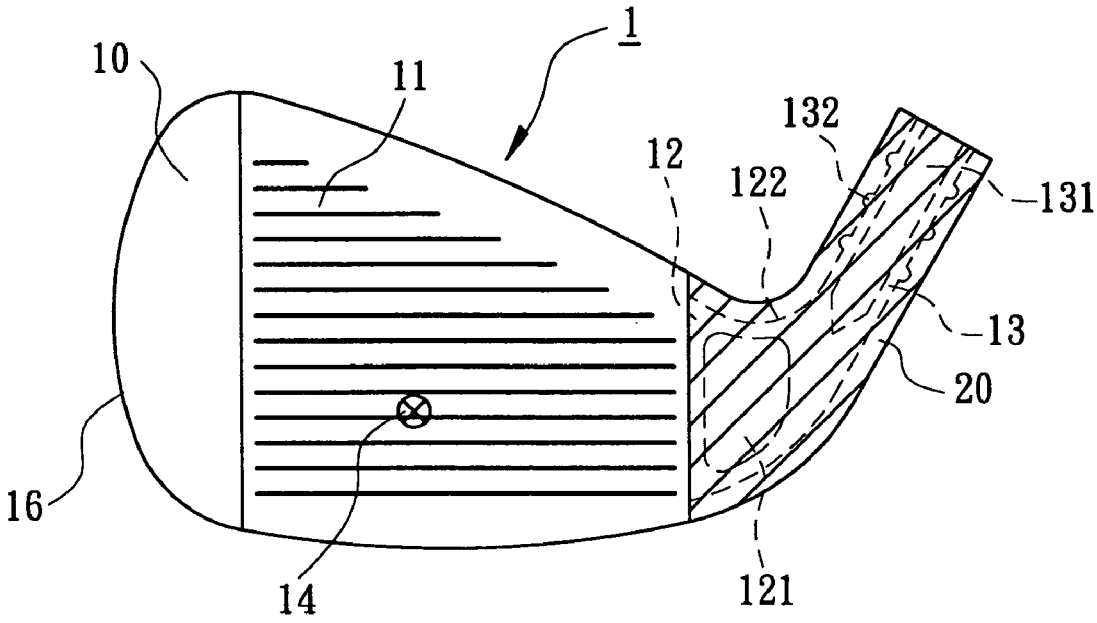
FIG. 9 is a front view of the fourth embodiment of the golf club head in accordance with the present invention.

FIG. 9 illustrates a fourth embodiment of the golf club head in accordance with the present invention that is modified from the embodiment of FIGS. 7 and 8. In this embodiment, the reduced section 122 on the hosel 13 includes at least one protrusion 132 on an outer periphery thereof. The respective protrusion 132 includes an annular, circular, or elongated section. Thus, the bonding stability and reliability between the wrapping layer 20 and the reduced section 122 are improved by the respective protrusion 132.

Figure 10:
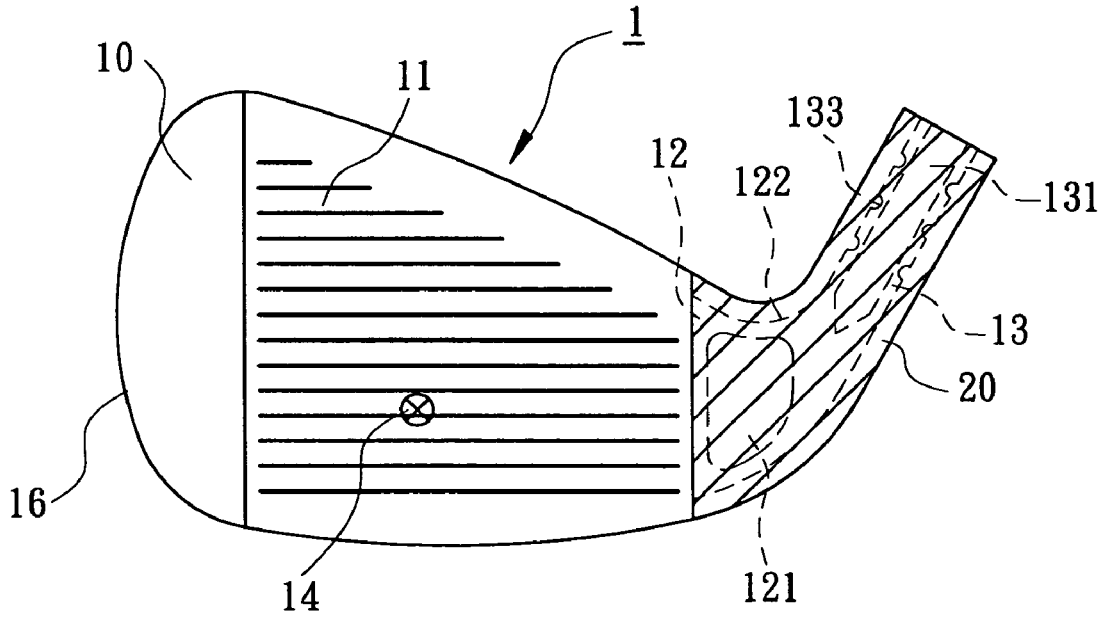
FIG. 10 is a front view of a fifth embodiment of the golf club head in accordance with the present invention.

FIG. 10 illustrates a fifth embodiment of the golf club head in accordance with the present invention that is modified from the embodiment of FIGS. 7 and 8. In this embodiment, the reduced section 122 on the hosel 13 includes at least one recessed portion 133 on an outer periphery thereof. The respective recessed portion 133 includes an annular, circular, or elongated section, thereby improving the bonding stability and reliability between the reduced section 122 and the wrapping layer 20.

Figure 11:
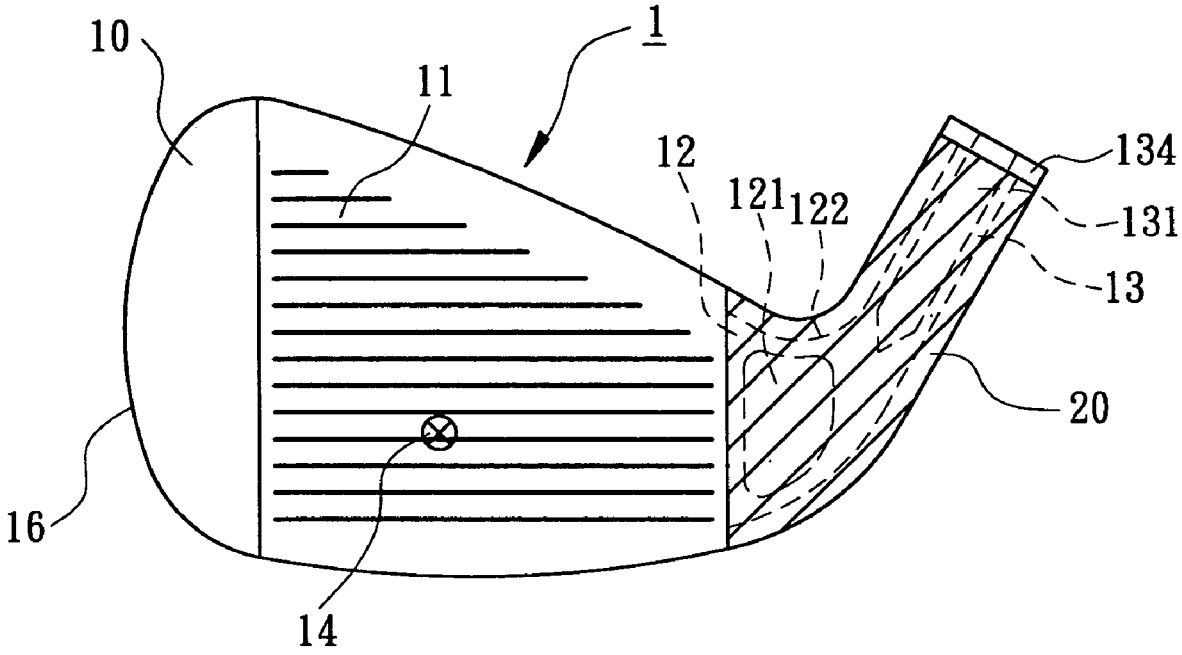
FIG. 11 is a front view of a sixth embodiment of the golf club head in accordance with the present invention.

FIG. 11 illustrates a sixth embodiment of the golf club head in accordance with the present invention that is modified from the embodiment of FIGS. 7 and 8. In this embodiment, the hosel 13 further includes a flange 134 on a distal end thereof that is distal to the golf club head body 10, thereby improving the bonding stability and reliability between the engaging hole 131 of the hosel 13 and the shaft.

Figure 12:
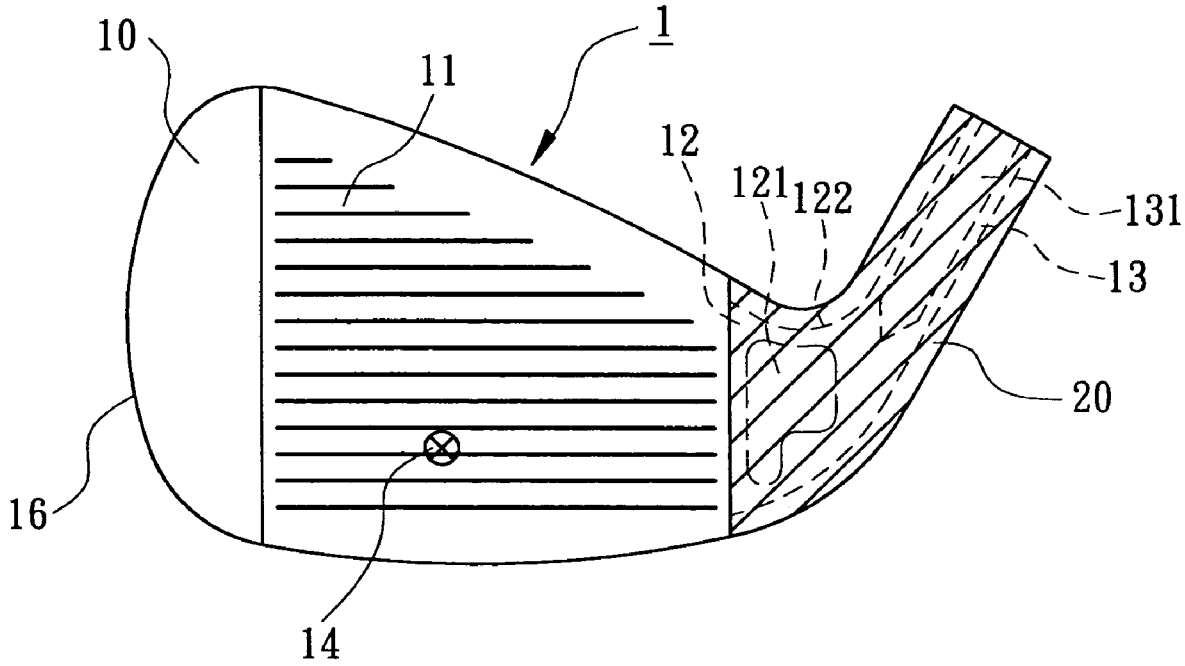
FIG. 12 is a front view of a seventh embodiment of the golf club head in accordance with the present invention.

FIG. 12 illustrates a seventh embodiment of the golf club head in accordance with the present invention, wherein the hole 121 of the heel 12 has a relatively wider left portion and a relatively narrower right portion (when viewed from front), or the hole 121 of the heel 12 has a relatively wider upper portion and a relatively narrower lower portion. This further shifts the center of gravity 14 of the golf club head 1 toward the toe 16. Further, the weight of the upper portion of the golf club head 1 is reduced, which causes downward shifting of the center of gravity 14 of the golf club head 1. Again, the inertial moment of the golf club head 1 is increased and the striking effect of the golf club head 1 is improved.

In conclusion, the center of gravity 14 of the golf club head 1 in accordance with the present invention is shifted outwardly without adversely affecting the strength of the golf club head 1, which cannot be achieved by the prior art golf club heads. Shifting of the center of gravity 14 of the golf club head 1 is achieved by providing a hole 121 in the heel 12. Further, a wrapping layer 20 is mounted on the reduced section 122 to further increase the inertial moment and the adjustment range of the center of gravity and to further improve the striking effect, shock-absorbing capacity, structural strength.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head, comprising:

a golf club head body having a toe and an engaging portion to which a striking plate is adapted to be mounted;

a hosel mounted to a side of the golf club head body, the hosel being adapted to engage with a shaft; and a heel between the hosel and the engaging portion of the golf club head body, the heel including a reduced section and a hole for reducing a weight of the heel, thereby shifting a center of gravity of the golf club head toward the toe of the golf club head body and increasing an inertial momentum of the golf club head, the hole of the heel being a through-hole.

2. The golf club head as claimed in claim 1, wherein the hole of the heel includes a relatively wider left portion and a relatively narrower right portion.

3. The golf club head as claimed in claim 1, wherein the hole of the heel includes a relatively wider upper portion and a relatively narrower lower portion.

4. The golf club head as claimed in claim 1, further including a light material filled in the hole of the heel, thereby improving a structural strength of the heel and absorbing a shock generated as a result of striking a golf ball.

5. The golf club head as claimed in claim 4, wherein the light material is selected from a group consisting of carbon fiber, resin, rubber, high molecular polymeric material, and light alloy.

6. The golf club head as claimed in claim 1, further including a wrapping layer made of light material, the wrapping layer wrapping around the reduced section of the heel and filling the hole of the heel, thereby improving structural strength of the heel and absorbing a shock generated as a result of striking a golf ball.

7. The golf club head as claimed in claim 6, wherein the light material is selected from a group consisting of carbon fiber, resin, rubber, high molecular polymeric material, and light alloy.

8. The golf club head as claimed in claim 6, wherein the wrapping layer wraps the reduced section of the hosel by one of heat pressing and injection molding.

9. The golf club head as claimed in claim 1, wherein the heel and the hosel are formed on the side of the golf club head body by one of precision casting, casting, mechanical processing, press casting, forging, and injection molding.

10. The golf club head as claimed in claim 1, wherein the heel and the hosel are engaged to the side of the golf club head body by section-by-section engagement.

11. A golf club head, comprising:

a golf club head body having a toe and an engaging portion to which a striking plate is adapted to be mounted;

a hosel mounted to a side of the golf club head body, the hosel being adapted to engage with a shaft; and a heel between the hosel and the engaging portion of the golf club head body, the heel including a hole for reducing a weight of the heel, thereby shifting a center of gravity of the golf club head toward the tow of the golf club head body and increasing an inertial momentum of the golf club head, wherein the heel includes a reduced section, and wherein the hosel includes a reduced section that is an extension of the reduced section of the heel, thereby decreasing a weight of an upper portion of the golf club head and shifting the center of gravity downward.

12. The golf club head as claimed in claim 11, further including a wrapping layer which wraps the reduced section on the hosel.

13. The golf club head as claimed in claim 11, wherein the hosel includes an engaging hole for engaging with a shaft, the reduced section on the hosel extending through an entire length of the heel, a wrapping layer wrapping the reduced section on the hosel, the reduced section on the hosel including a flange formed on a distal end of the hosel for improving bonding stability between the engaging hole of the hosel and the shaft.

14. The golf club head as claimed in claim 13, wherein the reduced section on the hosel includes at least one protrusion on an outer periphery thereof for improving bonding stability between the reduced section and the wrapping layer.

15. The golf club head as claimed in claim 13, wherein the reduced section on the hosel includes at least one recessed portion on an outer periphery thereof for improving bonding stability between the reduced section and the wrapping layer.

16. The golf club head as claimed in claim 12, wherein the hole of the heel includes a relatively wider left portion and a relatively narrower right portion.

17. The golf club head as claimed in claim 12, wherein the hole of the heel includes a relatively wider upper portion and a relatively narrower lower portion.

18. The golf club head as claimed in claim 11, further including a light material filled in the hole, the light material is selected from a group consisting of carbon fiber, resin, rubber, high molecular polymeric material, and light alloy.

19. The golf club head as claimed in claim 11, wherein the hole of the heel is a blind hole having an opening in a front side of the heel.

20. The golf club head as claimed in claim 11, wherein the hole of the heel is a blind hole having an opening in a rear side of the heel.

* * * * *